US009523543B1

(12) United States Patent
Brown

(10) Patent No.: US 9,523,543 B1
(45) Date of Patent: Dec. 20, 2016

(54) GAS SYSTEM WITH MULTI-PORTED BARREL

(71) Applicant: AMBIMJB, LLC, Baltimore, MD (US)

(72) Inventor: Michael Jay Brown, Baltimore, MD (US)

(73) Assignee: AMBIMJB, LLC, Baltimore, MD (US)

( * ) Notice: Subject to any disclaimer, the term of this patent is extended or adjusted under 35 U.S.C. 154(b) by 0 days.

(21) Appl. No.: 15/049,624

(22) Filed: Feb. 22, 2016

(51) Int. Cl.
*F41A 19/02* (2006.01)
*F41A 5/26* (2006.01)

(52) U.S. Cl.
CPC ..... *F41A 5/26* (2013.01)

(58) Field of Classification Search
USPC ..... 89/129.01, 130, 191.01, 193
See application file for complete search history.

(56) References Cited

U.S. PATENT DOCUMENTS 2,748,662 A 6/1956 Simpson
3,443,477 A 5/1969 Kaempf
7,934,447 B2 5/2011 Kuczynko et al.
8,065,949 B1 11/2011 Molinari
8,393,259 B2 3/2013 Larue
9,212,856 B2 12/2015 Baker
2010/0275770 A1* 11/2010 Noveske ..... F41A 5/28 89/193
2013/0055883 A1* 3/2013 Cassels ..... F41A 5/28 89/193
2014/0174285 A1* 6/2014 Baker ..... F41A 5/22 89/129.01
2016/0202012 A1* 7/2016 Kokinis ..... F41A 21/00 89/193

* cited by examiner

*Primary Examiner* — J. Woodrow Eldred
(74) *Attorney, Agent, or Firm* — Wood Herron & Evans LLP

(57) ABSTRACT

Provided is a gas operated firearm timing selection system having a barrel, first and second gas blocks, a gas delivery tube, and a selector tube. The barrel has at least first and second longitudinally spaced apart gas port locations. First and second gas blocks each correspond to one of the gas port locations. The gas delivery tube operably extends between the first gas block and an operating system of the firearm. The selector tube operably extends between the gas blocks to convey operating gas from either of the gas port locations and is selectively displaceable between at least a first position and a second position. Each position provides gas flow from only one of the gas port locations such that the timing of operating gas flow to the operating system is changed by selection between first and second positions.

7 Claims, 3 Drawing Sheets

GAS SYSTEM WITH MULTI-PORTED BARREL

FIELD OF THE INVENTION

The present invention relates to a gas operating system for a semi-automatic firearm. In particular, it relates to a gas system in which the barrel has multiple, longitudinally spaced apart gas ports.

BACKGROUND OF THE INVENTION

Designers of propellant gas pressure operation systems for semi-automatic firearms have found it particularly challenging to produce a system that will operate reliably using ammunition with significant differences in muzzle velocities and chamber pressures. For example, the .300 Blackout (.300BLK) caliber is available in both supersonic and subsonic velocities. Because it uses the same magazine and bolt in an AR15-pattern firearm as those used for .223/5.56 caliber ammunition, the popularity of .300 Blackout has grown in recent years. Users may choose ammunition in this caliber loaded for supersonic velocities to extend its effective range, but may also select subsonic loads to minimize noise by eliminating the transonic "crack" created by supersonic velocities, particularly when used in conjunction with a firearm noise suppressor or "silencer." As used herein, ammunition "load" means a particular combination of propellant and projectile, for a given caliber, that produces different ballistic results, such as chamber pressure and velocity.

While the exact speed of sound in air varies depending on atmospheric conditions, ammunition with a muzzle velocity less than about 1,040 feet per second (FPS) is generally considered "subsonic" in that it does not exceed the speed of sound and the transonic "crack" associated with it. For example, subsonic .300BLK ammunition using a 220 grain bullet can have a chamber pressure of approximately 21,000 pounds per square inch (PSI) and a muzzle velocity of approximately 1,010 FPS. In contrast, a .300 Blackout cartridge loaded for supersonic velocities may use a 125 grain bullet to produce a chamber pressure of approximately 55,000 PSI and a muzzle velocity of approximately 2,215 FPS. Because of these vastly different specifications, it has been difficult to design a gas-operated semi-automatic system that will operate reliably using both types of ammunition, even though it is the same caliber. This is particularly the case with direct impingement operating systems, the most common for the AR15 platform.

Prior solutions have focused on adjusting the flow of operating gas delivered to the bolt carrier assembly of a direct impingement system. For example, systems have selected between one or more than one of multiple barrel ports located at or near the same longitudinal position. This adjusts gas flow by increasing or decreasing the total cross-sectional area of the gas passageway. But adjusting gas flow alone is inadequate to provide reliable operation for ammunition producing vastly different projectile velocities and pressures. Typically, such systems operate reliably with either supersonic or subsonic ammunition, but not both. Systems that seek to provide a compromise between the demands of these vastly different ammunition loads ultimately may not provide reliability for either.

SUMMARY OF THE INVENTION

The present invention primarily provides an adjustment in timing of operation in the gas system by selecting between one of at least two longitudinally spaced apart gas ports in the barrel.

The gas operated firearm timing selection system disclosed includes a barrel, first and second gas blocks, a gas delivery tube, and a selector tube. The barrel has at least first and second longitudinally spaced apart gas port locations. First and second gas blocks each correspond to one of the gas port locations. The gas delivery tube operably extends between the first gas block and an operating system of the firearm. The selector tube operably extends between the gas blocks to convey operating gas from either of the gas port locations and is selectively displaceable between at least a first position and a second position. Each position provides gas flow from only one of the gas port locations such that the timing of operating gas flow to the operating system is changed by selection between first and second positions.

According to other aspects of the invention, a third selector tube position may be provided at which gas flow is blocked from all gas port locations to eliminate automatic gas operating cycling of the firearm. Displacement between first, second, and/or third positions is effected by axial rotation of the selector tube. The gas delivery tube and selector tube may be axially aligned and/or unitary. When axially aligned, the gas delivery tube and selector tube may be axially aligned with a gas key of the operating system.

Other aspects, features, benefits, and advantages of the present invention will become apparent to a person of skill in the art from the detailed description of various embodiments with reference to the accompanying drawing figures, all of which comprise part of the disclosure.

BRIEF DESCRIPTION OF THE DRAWINGS

Like reference numerals are used to indicate like parts throughout the various figures of the drawing, wherein.

DETAILED DESCRIPTION

Figure 1:
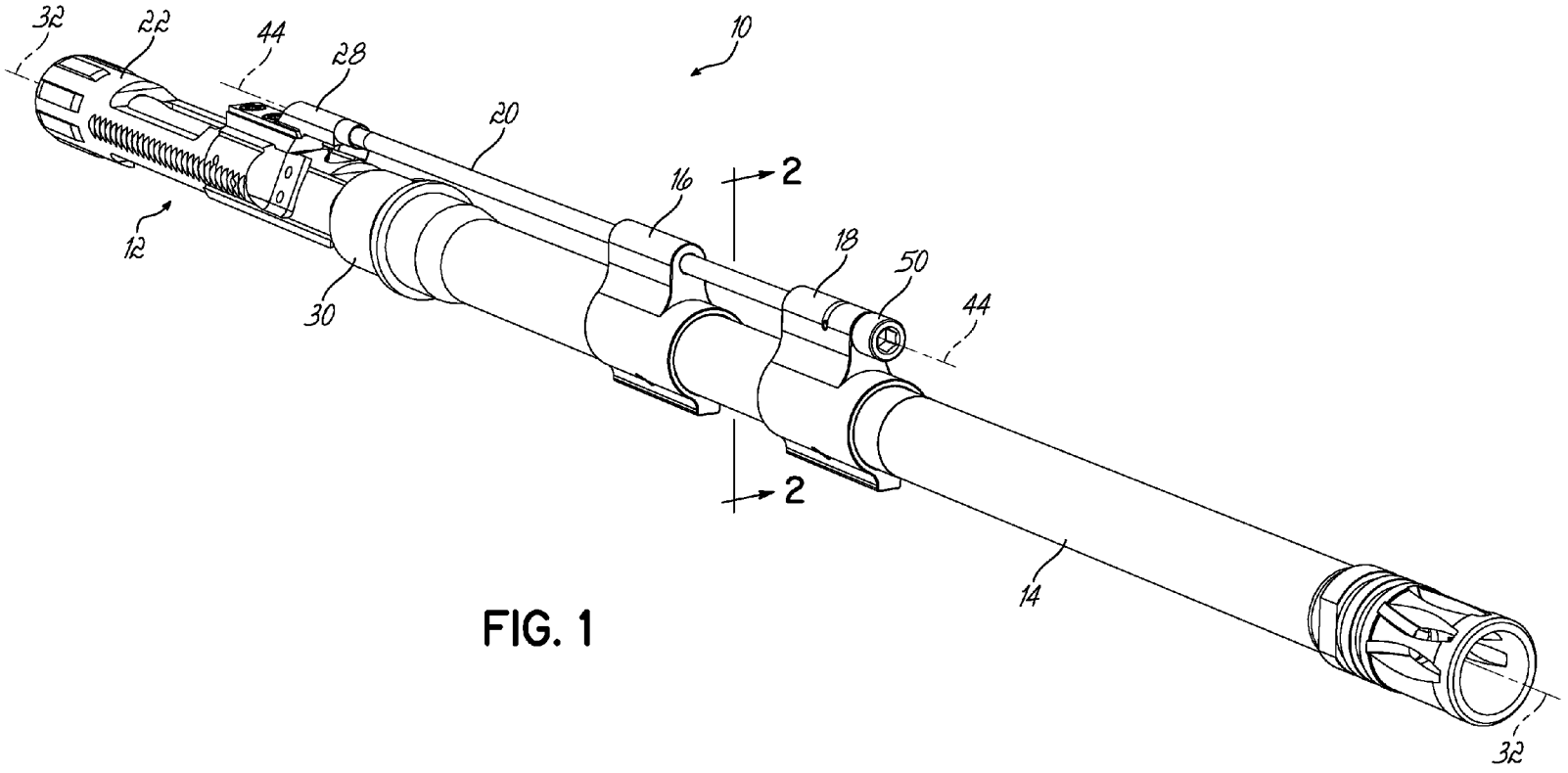
FIG. 1 is an isometric view of a barrel, bolt carrier assembly, and gas system for an AR15-pattern firearm according to one embodiment of the present invention.

With reference to the drawing figures, this section describes particular embodiments and their detailed construction and operation. Throughout the specification, reference to "one embodiment," "an embodiment," or "some embodiments" means that a particular described feature, structure, or characteristic may be included in at least one embodiment. Thus appearances of the phrases "in one embodiment," "in an embodiment," or "in some embodiments" in various places throughout this specification are not necessarily all referring to the same embodiment. Furthermore, the described features, structures, and characteristics may be combined in any suitable manner in one or more embodiments. In view of the disclosure herein, those skilled in the art will recognize that the various embodiments can be practiced without one or more of the specific details or with other methods, components, materials, or the like. In some instances, well-known structures, materials, or operations are not shown or not described in detail to avoid obscuring aspects of the embodiments.

Figure 2:
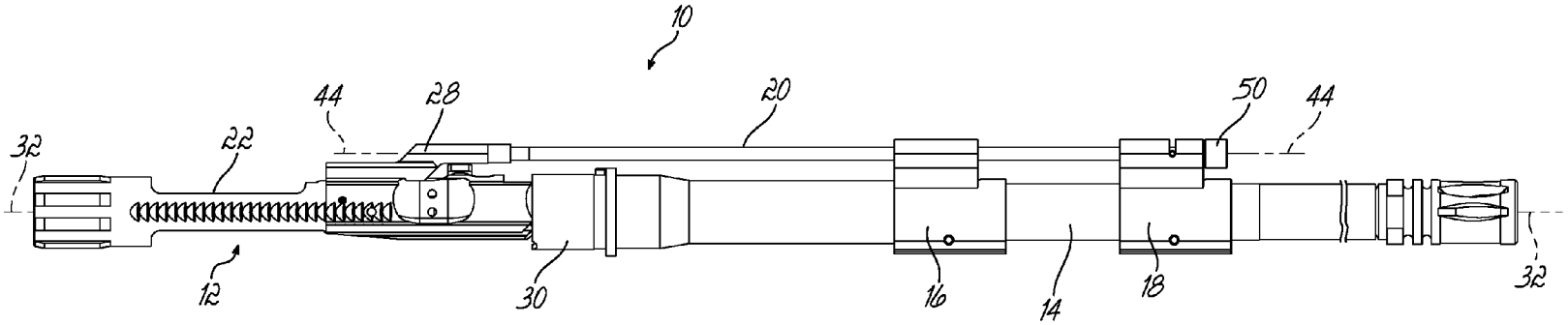
FIG. 2 is a side elevation view thereof (with a portion of the barrel removed to decrease length of the figure)
Figure 3:
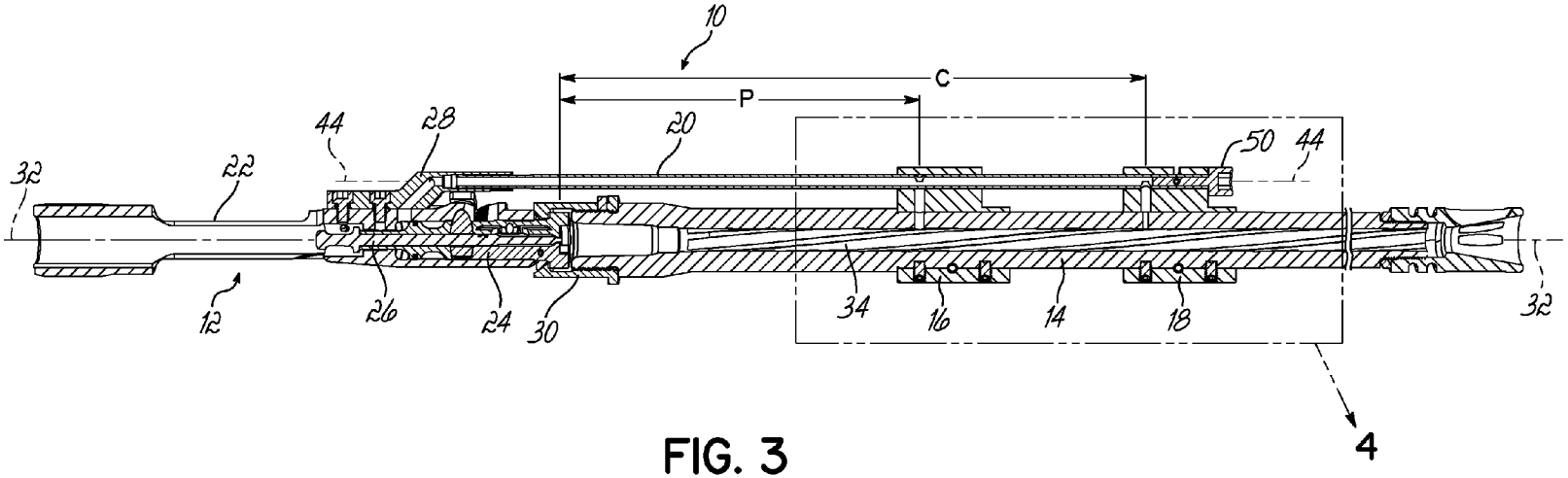
FIG. 3 is a longitudinal sectional side elevation view thereof taken substantially along line 2-2 of FIG. 1 (with a portion of the barrel removed to decrease length of the figure)

Referring to the various figures of the drawings, and first to FIGS. 1-3, therein is shown at 10 a gas system for a semi-automatic firearm according to one embodiment of the present invention. The illustrated embodiment is that of an AR15-pattern firearm that may be chambered, for example, for .300BLK caliber ammunition. The present invention is readily adaptable, however, for other gas-operated semi-automatic firearm systems and other calibers available in more than one significantly different loads.

FIGS. 1-3 show only those parts of such a firearm necessary for the understanding of the present invention, including a bolt carrier assembly 12, a barrel 14, first and second gas blocks 16, 18 and a gas tube 20. As shown in FIG. 3, the bolt carrier assembly 12 in a direct impingement gas operating system includes a bolt carrier 22, a bolt 24, a firing pin 26, and a gas key 28. Operation of the bolt carrier assembly 12 is well known to a person of ordinary skill in this field and other parts are either unlabeled or not shown for sake of clarity. The bolt 24 engages with a barrel extension 30 when in the in-battery position, as shown, and is substantially axially aligned with the longitudinal axis 32 of the barrel bore 34. The gas key 28 is offset to align with and engage the gas tube 20, directing operating gas flow from the gas tube 20 into the body of the bolt carrier 22, as is well known.

Figure 4:
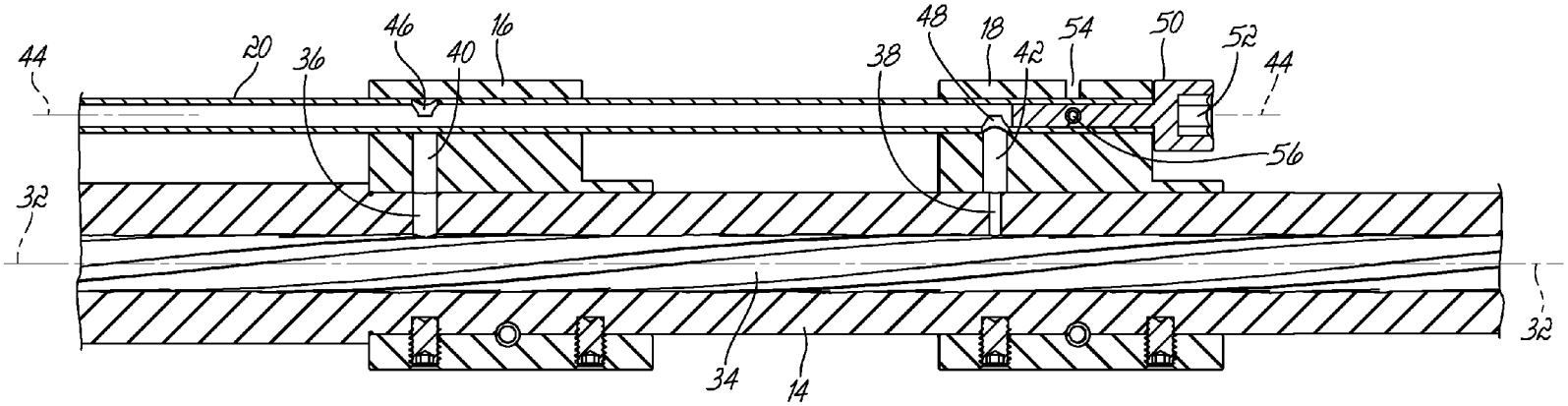
FIG. 4 is an enlarged, fragmentary side sectional view showing the longitudinally spaced apart gas ports and gas blocks according to this embodiment of the invention.

In the illustrated embodiment, with an overall barrel length of approximately 16 inches, a first gas port 36 is provided at a first distance P from the bolt face and a second gas port 38 is provided at a second distance C from the bolt face. The position of these longitudinally spaced apart gas ports 36, 38 may, for example, correspond to the typical position of gas ports in a pistol length barrel (P=4.744") and that of a carbine length barrel (C=7.760"). Referring now also to FIG. 4, separate, spaced apart gas blocks 16, 18 are provided in alignment with the gas ports 36, 38 to direct gas flow through respective passageways 40, 42 to the gas tube.

The gas blocks 16, 18 may be fixed to the barrel 14 in any commonly known manner. For purposes of the present invention, multiple gas ports located at substantially the same longitudinal position on the barrel would considered a single port position. To function according to the present invention, a plurality of gas ports need to be spaced apart longitudinally on the barrel a sufficient distance to affect the timing of the operation of the action relative to the location of the projectile being fired.

The system of the present invention could be used with a gas operating system other than a direct impingement system. In such case, the operating gas flow from the gas blocks 16, 18 would be delivered to another mechanism of the gas operating system, such as a gas piston (not shown). In either case, the timing of the gas operating system is changed by selection between one or the other of the longitudinally spaced apart gas port locations.

Unlike other gas tube configurations in which low profile gas blocks require the gas tube to include an offset bend for alignment with the gas key 28, the gas blocks 16, 18 receive the gas tube 20 in axial alignment with the gas key 28 in the illustrated embodiment. Accordingly, the gas tube extends along an axis 44 that is substantially parallel to the barrel bore axis 32 and the gas tube is substantially straight.

Selection between the two gas ports 36, 38 can be achieved by movement of the gas tube 20 to selectively position one of the inlet openings 46, 48 in alignment with its respective gas block passageway 40, 42. In the illustrated embodiment, selection is achieved by rotating the gas tube 20. The inlet openings 46, 48 are positioned opposite one another such that rotation of about 180 degrees will cause only one of the inlets to be operably positioned with one of the gas passageways 40, 42 and gas ports 36, 38. Alternatively, selection could be made in another manner, such as longitudinal (axial) displacement. If manual cycling of the bolt carrier assembly 12 is desired, such as to minimize the noise emitted from the firearm when fired, the gas tube 20 could be positioned at an intermediate setting, such that neither of the inlets 46, 48 is aligned with a gas passageway 40, 42 and the firearm will not automatically cycle. Seals (not shown), such as o-rings or the like, may be used where the gas tube 20 is fitted into the gas blocks 16, 18.

An actuation member 50 may be used to selectively position the gas tube 20. In the illustrated embodiment, the actuation member 50 may be press fit or threaded into the forward end of the gas tube 20 to contain the pressurized gas flow. The member 50 may include a socket 52 to facilitate rotation with a tool (not shown). Alternatively, the member 50 may include a lever or other extension (not illustrated) to facilitate manipulation without use of a tool.

The forward gas block 18 may also include a slot 54 to accommodate a retention pin 56 inserted through corresponding openings in the actuation member 50 and gas tube 20. The retention pin 56 secures the actuation member 50 to the gas tube 20 and retains both in place in the forward gas block 18 and inlet openings 46, 48 in alignment with the gas block passageways 40, 42. Additionally, extension of the retention pin 56 from one side may be used to limit rotational travel of the gas tube 20 and actuation member 50 to a fixed extent, such as approximately 180 degrees. If desired, a detent (not shown) may be added to hold the position of the gas tube 20 and actuation member 50 at preselected intervals.

By spacing the gas ports 36, 38 a significant longitudinal distance apart, using the port 36 at the first location for the lower-pressure, lower-speed subsonic load and the port 38 at the second location for the higher-pressure, higher-speed supersonic load, the timing of cycling of the action is significantly changed, making the semi-automatic operation of the system reliable for either load. The diameter of the ports 36, 38 (determining volume of gas flow) may be varied as well, but it is the longitudinal spacing and selection of one port or the other to match the load that is significant in determining the timing of the action cycle and reliability of the system for the vastly different specifications of the subsonic and supersonic loads. By axially aligning the position of the gas tube 20 through the gas blocks 16, 18 with the gas key 28, the construction of the switching system can be greatly simplified, as shown.

Figure 5:
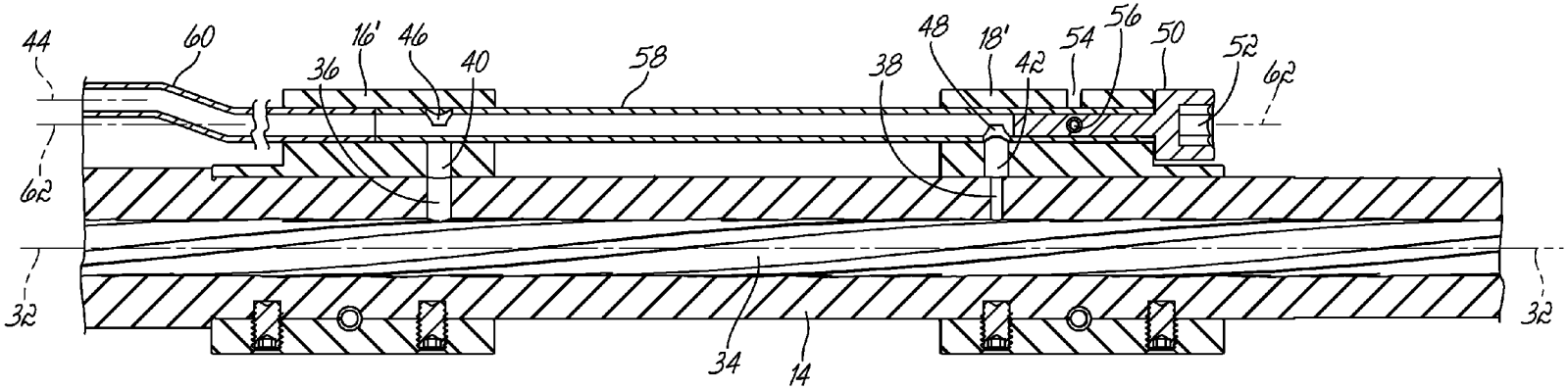
FIG. 5 is a similar enlarged, fragmentary side sectional view showing an alternate embodiment configuration.

In an alternative embodiment, an example of which is illustrated in FIG. 5, a selector tube 58 can be used for connecting gas flow between the gas blocks 16', 18' and selectively opening flow through one of the ports 36, 38, while a separate gas transfer tube 60, that does not rotate or otherwise move with the selector tube 58, provides a gas flow conduit from the rearmost gas block 16 to the gas operating system (gas key 28, in a direct impingement system). This alternate arrangement would allow the separate gas transfer tube 60 to include an offset bend between the gas tube axis 44 aligned with the gas key 28 and the lowered rotational axis 62 of the selector tube 58, if desired. Additionally, this configuration allows the gas blocks 16', 18' to have a lower profile. Again, seals (not shown), such as o-rings or the like, may be used where the gas tube 60 and/or selector tube 58 are fitted into the gas blocks 16', 18'.

While certain embodiments of the present invention have been described in detail, it should be apparent that modifications and variations thereto are possible, all of which fall within the true spirit and scope of the invention. Therefore, the foregoing is intended only to be illustrative of the principles of the invention. Further, since numerous modifications and changes will readily occur to those skilled in the art, it is not intended to limit the invention to the exact construction and operation shown and described. Accordingly, all suitable modifications and equivalents may be included and considered to fall within the scope of the invention, defined by the following claim or claims.

What is claimed is:

1. A gas operated firearm timing selection system, comprising:

a barrel having at least first and second longitudinally spaced apart gas port locations;

first and second gas blocks, one corresponding to each of the gas port locations;

a gas delivery tube operably extending between the first gas block and an operating system of the firearm; and a selector tube operably extending between the gas blocks to convey operating gas from either of the gas port locations and selectively displaceable between at least a first position and a second position, each position providing gas flow from only one of the gas port locations such that the timing of operating gas flow to the operating system is changed by selection between first and second positions.

2. The system of claim 1, wherein displacement between first and second positions is effected by axial rotation of the selector tube.

3. The system of claim 1, further comprising a third selector tube position at which gas flow is blocked from all gas port locations to eliminate automatic gas operating cycling of the firearm.

4. The system of claim 3, wherein displacement between first, second, and third positions is effected by axial rotation of the selector tube.

5. The system of claim 1, wherein the gas delivery tube and selector tube are axially aligned.

6. The system of claim 5, wherein the gas delivery tube and selector tube are unitary.

7. The system of claim 5, wherein the gas delivery tube and selector tube are axially aligned with a gas key of the operating system.

* * * * *